US007748871B2

(12) United States Patent
Walton

(10) Patent No.: US 7,748,871 B2
(45) Date of Patent: Jul. 6, 2010

(54) LIGHTING APPARATUS

(76) Inventor: Randal D. Walton, 66 Hacienda Dr., Napa, CA (US) 94558

( * ) Notice: Subject to any disclaimer, the term of this patent is extended or adjusted under 35 U.S.C. 154(b) by 198 days.

(21) Appl. No.: 12/070,712

(22) Filed: Feb. 19, 2008

(65) Prior Publication Data

US 2008/0232109 A1 Sep. 25, 2008

Related U.S. Application Data

(63) Continuation-in-part of application No. 10/393,816, filed on Mar. 21, 2003, and a continuation-in-part of application No. 11/588,959, filed on Oct. 27, 2006, now Pat. No. 7,390,106.

(51) Int. Cl.
*F21V 7/00* (2006.01)

(52) U.S. Cl. ..... 362/296.01; 362/216; 362/347

(58) Field of Classification Search ..... 362/269.01, 362/216, 347, 254
See application file for complete search history.

(56) References Cited

U.S. PATENT DOCUMENTS

| | | | | |
|---|---|---|---|---|
| 1,870,147 | A | 8/1932 | Smally | |
| D113,550 | S * | 2/1939 | Clark | 362/216 |
| 3,179,792 | A | 4/1965 | Weiss | 240/11.4 |
| 3,558,873 | A | 1/1971 | Smith | 240/51.11 |
| 6,033,092 | A | 3/2000 | Simon | 362/298 |
| 6,068,388 | A | 5/2000 | Walker et al. | 362/304 |
| 6,291,936 | B1 | 9/2001 | MacLennan et al. | 315/39 |
| 6,356,700 | B1 | 3/2002 | Strobl | 385/147 |
| 2002/0149931 | A1 | 10/2002 | Chang | 362/216 |
| 2004/0184269 | A1 * | 9/2004 | Walton | 362/216 |

OTHER PUBLICATIONS

"Energy Efficiency: LED Lights to Replace Lightbulbs?", Alternative Energy Blog—Solar-Energy-Wind-Power.Com, Apr. 19, 2005, 18 pages.

* cited by examiner

*Primary Examiner*—David V Bruce
(74) *Attorney, Agent, or Firm*—Mohr Intellectual Property Law

(57) ABSTRACT

The present invention comprises a method of enhancing illumination by a variety of lamp types through the use of reflective technologies, for example, replacement of expensive high intensity density of mercury vapor lamps with low wattage fluorescent tubes having at least one and in some cases, up to three reflective surfaces for focusing otherwise lost light toward a target illumination area. Further, the placement of light sources at the focal point of said reflective surfaces aids in optimizing the amount of light focused in a desired direction.

19 Claims, 15 Drawing Sheets

LIGHTING APPARATUS

CROSS-REFERENCE TO RELATED APPLICATIONS

This is a continuation-in-part of applications, Ser. No. 10/393,816, filed on Mar. 21, 2003, and 11/588,959, filed on Oct. 27, 2006 now U.S. Pat. No. 7,390,106, which are hereby incorporated by reference for all purposes.

FIELD OF THE INVENTION

The instant invention may be considered to be in the field of lighting devices, specifically lamps of high intensity discharge and fluorescent lamps, but not limited thereto.

BACKGROUND OF INVENTION

Many industrial and commercial buildings have the burden of illuminating large areas from standard height as well as from higher than normal ceilings. One solution to this lighting application has been the use of high intensity discharge lamps. Mercury vapor, sodium and other high intensity discharge lamps in commercial applications may consume as much as 400 to 1000 watts, and generate an associated amount of heat, contributing to additional heating, ventilating and air conditioning ("HVAC") operation and fire protection considerations.

These lamps also utilize a certain time duration to warm up and achieve full illumination capability, resulting in time periods with less than desired lighting coverage. Such high intensity discharge lamps are also relatively expensive costing several hundreds of dollars per lamp.

Lamp manufacturers are constantly looking for ways to maximize the amount of foot candles of illumination which can be generated for a fixed amount of power consumption or wattage. These objectives have resulted in the evolution of high intensity discharge lamps which burn metallic vapors to achieve high lumen output.

A fairly common discharge lamp with a reflective lamp is disclosed in U.S. Pat. No. 6,291,936 B, issued Sep. 18, 2001 to MacLennan et al. Summarizing, the MacLennan patent discloses a discharge lamp including an envelope, a source of excitation power coupled to the fill for excitation thereof and thereby emit light, a reflector disposed around the envelope and defining an opening, and a reflector configured to reflect some of the light emitted by the fill back into the fill while allowing some light to exit through the opening. This description is typical of a high intensity discharge lamp. The high pressure sodium lamp emits the brightest light while metal halide and mercury vapor lamps emit about the same amount of light. For a lamp in the 400 W range, for example, a ballast which acts as the excitation for the fill may typically consume 40 to 58 watts.

Fluorescent lamps are also used in commercial applications, often in offices and warehouses where a plurality of fluorescent tubes are positioned in front of a washboard-shaped, mirrored reflector. The purpose of the reflector is to reflect the light emitted upward back down toward the targeted illumination area. Fluorescent lamps differ from high intensity discharge lamps in that the "strike" time (the time to excite the interior of the lamp) is short—almost immediate, where the high intensity discharge lamps must warm up to full illumination. Fluorescent lamps also operate at a cooler temperature than do high intensity discharge lamps. The same approach may be applied to retrofitting existing installations in the commercial office environment.

Fluorescent lamps are also used in residential applications. A growing trend is the replacement of incandescent lamps with fluorescent lamps to achieve not only brighter light, but also savings in power consumption.

Lamps like the Sylvania ICETRON lamp are touted as having a 100,000 hour lamp life, or roughly five times the life of a standard high intensity discharge lamp. Consequently, with such added lamp life, the amount of maintenance required to change lamps in order to maintain illumination is reduced by 80%.

When one examines the shortcomings attendant to the use of high intensity discharge lamps and the advantages of fluorescent lamps, several observations result. By comparison, fluorescent lamps provide crisp white light in comparison to high intensity discharge lamps which offer unpleasant color and distracting color shift. Fluorescent lights my also be flexibly dimmed whereas high intensity discharge lights may not be operated below 50% output.

What is needed is a lamp which can illuminate a target area with the same amount of foot candles as a high intensity discharge lamp without consuming the same amount of energy, without requiring a warm-up period, and in operation generating less heat.

There exists a further need for high intensity discharge lamps which can illuminate a target area with the same amount of foot candles as a higher wattage, high intensity discharge lamp without consuming the same amount of energy.

Also, what is needed is a lamp which can illuminate a target area with the equivalent of foot candles as an incandescent lamp, but without consuming the same amount of energy.

Further, if the illuminating capability of a high intensity discharge lamp could be accomplished without the high capital cost associated with the purchase and operation of such lamps, the relative operating cost of illuminating industrial and commercial buildings would be reduced. The same can be said for the improvement of residential illuminations as well.

If such a lamp as described immediately above were developed, the cost of retrofitting fixtures with such lamps would be paid for relatively quickly by the associated savings from reductions in energy consumption.

One area of the art that remains to be fully developed is the optimal use of reflective surfaces to assist in directing light which would normally travel away from the targeted illumination area.

SUMMARY OF THE INVENTION

The present invention combines the advantages of compact fluorescent light tubes with reflective technology aimed at retrofitting high intensity discharge lamps in industrial and commercial applications. Applicant's invention also combines the advantages of high intensity discharge, incandescent and other light sources with reflective technology aimed at retrofitting each type of lamp for industrial, commercial, and residential applications.

By using a combination of cooler operating fluorescent tube lamps with concentrating reflective surfaces, an equivalent illumination result can be achieved at a reduction in energy consumption in the range of 40% to 74%. As a result of the much lower cost of a compact fluorescent lamp, multiple lamps may be used in combination to generate the equivalent illumination of a target area as that of high intensity discharge lamps.

The present invention utilizes reflective surfaces in a variety of ways to increase the intensity of light delivered to the target illumination area.

First, the lamp glass may be manufactured having a reflective surface to reflect light which would normally emanate away from the target illumination area back toward the target area, thereby increasing the amount of light delivered to said target illumination area ("TIA").

Second, a housing which is normally used for lamps such as a semi-conical or paraboloid-shaped high bay fixture, or a flat "washboard" type reflector may be retrofitted with a combination lamp and reflector which not only uses whatever reflective capability exists in the housing, but adds its own intensity focus factor to deliver light to the TIA, even delivering an equivalent amount of light at much less of a wattage rating (and thereof less power consumption) than the original lamp or lamps in the housing.

In a first embodiment of the present invention, a spiral fluorescent tube is combined with an interior reflector and a single secondary paraboloid reflector. A third reflector such as a semi-conical or paraboloid shape can be utilized by positioning the floodlight fixture at the focal point of said reflector. Important in this case is the distance between the tubes themselves as well as between each tube and its associated reflectors.

The importance stems from the amount of space needed to allow the reflector to bounce light back past the tubes and toward the TIA, and also the space needed for dissipation of heat. Convection allows cool air to be drawn past the fins and dissipating heat will protect the ballast. The compact fluorescent floodlight has a lens designed to precisely control the light from the reflector. It is covered with small, detailed shapes to direct the light into the desired beam pattern. The lens also acts as a cover to allow the lamp to act as it own fixture.

A second embodiment of applicant's invention employs an "implant" consisting of a spirally configured fluorescent or compact fluorescent lamp which is fitted with a reflective surface proximate to the interior portion of the lamp itself. This implant may be retrofitted into a conventional high-bay industrial fixture, thereby delivering an equivalent amount of light to the TIA with less wattage consumed. Each spiral lamp has proximate to it a primary reflector to re-direct light which might otherwise be "lost," meaning not directed to the TIA, and as well, a secondary reflector which helps direct the light to a third reflector which finally directs the focused light to the TIA.

A third embodiment of applicants invention employs a high intensity discharge compact fluorescent lamp consisting of an array of "spirally" configured fluorescent lamps, each fitted with a reflective surface proximate to the interior portion of the lamp itself. This "HID" may be retrofitted into a conventional high-bay industrial fixture, thereby delivering an equivalent amount of light to the TIA with less wattage consumed. As in the case of the second embodiment, each spiral lamp has proximate to it a primary reflector to re-direct light which might otherwise be "lost," meaning not directed to the TIA, and as well, a secondary reflector which helps direct the light to a third reflector which finally directs the focused light to the TIA. This triple reflective light fixture could be placed in a fourth semi-conical or paraboloid shape reflector and can be utilized by positioning the floodlight fixture at the focal point of said reflector to increase the foot candles at the TIA and reduce energy consumption. Fins allow cool air to be drawn in, dissipating heat and protecting the ballast. The compact fluorescent floodlight has a lens designed to precisely control the light from the reflector. It is covered with small, detailed shapes to direct the light into the desired beam pattern, but could also be smooth. The lens also acts as a cover to allow the lamp to act as its own fixture.

In a fourth embodiment, a plurality of spiral lamps having primary reflectors is positioned inside a plurality of secondary reflectors. This array is then positioned inside a single third reflector having its own focusing characteristics, thereby further optimizing the delivery of light to the TIA. Consistent with the applicant's approach, the array is positioned at the focal point of the third reflector.

In a fifth, or preferred embodiment, of the instant invention a light source is positioned at the focal point of a reflective surface which optimizes the amount of light which is directed to the TIA. In this embodiment, a small wattage fluorescent tube is placed inside a second tube having a partially reflective surface and in some cases, a partial lens. An all-in-one open "said" Reflector Lamp can also be used by placing a smaller lamp at the focal point of said reflector. The placement of the smaller fluorescent tube is determined by the focal point of the second outer tube, thereby dependent upon the diameter of the second outer tube.

In a sixth embodiment of the present invention, a U-shaped tube is positioned at the focal point of a reflective surface thereby optimizing the amount of light which is directed to the TIA. Also, in this embodiment, a small wattage fluorescent tube is placed inside another tube or concave, open reflector having a partially reflective surface.

In a seventh embodiment of the instant invention, a high intensity discharge lamp employs a light source at the focal point of a reflective surface again optimizing the amount of light which is directed to the TIA. In this embodiment, a small wattage HID "said invention" Reflector Lamp is placed at the focal point of an outer second reflective surface. The placement of the small light source is again determined by the focal point of the bulb.

In another embodiment, an incandescent lamp employs a light source at the focal point of a reflective surface which optimizes the amount of light which is directed to the TIA. In this embodiment, a small wattage incandescent "same said" Reflector Lamp is placed at the focal point of an outer second reflective surface. The placement of the small light source is determined by the focal point of the bulb.

As one can see, a variety of different shaped lamps can be positioned in the focal point of a reflective surface, even taking advantage of a reflective surface with multiple facets, thereby increasing the amount of light reflected toward the TIA. The placement of the light is typically determined by the focal point of the reflector, thereby dependant upon its diameter. The resultant light delivered to the TIA is consistent with the values expressed in Tables A, B, and C.

The focal point is determined using the formulas developed to describe light reflected from a concave mirror. The equation may be expressed as $f=R/2$, where R is the radius of the mirror (in the case of the preferred embodiment, the outer tube) and f is the focal length, or the distance from the mirror where the light source should be placed for optimal reflection.

Graph 1 shown in FIG. 16 illustrates how the various types of lamps; i.e., fluorescent, halogen, mercury vapor and high pressure sodium compare with one another. As can be seen from the table, the fluorescent bulb has a higher color rendition index, or "CRI" than other lamp media utilizing the same wattage rating of power consumption.

Graph 2 shown in FIG. 17 shows the asymptotic relationship between an object's distance from the focal point of a reflector and the associated magnification.

Summarizing, the embodiments shown herein comprise seven examples of applicant's invention:

First, a compact or fluorescent lamp such as that already available on the open market, be it spiral, U-shaped, or other configuration, is fitted with a conical (or a variety of other shapes such as concave, or a flat washboard) reflector proximate to the exterior of the lamp glass itself. The purpose of the reflector is to redirect light toward the TIA which would normally scatter in all directions. This Reflector Lamp combination may also be used in conjunction with a single secondary reflector in a combination akin to what is commonly referred to as a floodlamp type apparatus. Positioning of the lamp or lamps in said secondary reflectors proximate to the focal points thereof is advantageously employed.

Second, an embodiment comprising a plurality of spiral fluorescent or compact fluorescent lamps each having a primary reflector is positioned inside a secondary reflector at the focal point forming an array. In this embodiment, a third reflector is employed at the focal point to provide additional direction or focusing of light toward the TIA.

The third embodiment utilizes a small fluorescent tube of low wattage placed proximate to the focal point of a larger tube having, in the preferred embodiment, a reflective hemisphere acting as a primary reflector. In this configuration, light may be directed with substantial increased intensity to the TIA, and when used with a secondary reflector, may provide even more intensity to the TIA.

The fourth embodiment utilizes the amount of space needed for reflector and tubes to allow cool air to flow past the space between reflector and tubes as heat dissipates. Fin spacing allows cool air to pass the fins thereby dissipating heat. Over heating will deteriorate lamp life of the fluorescent ballast.

A fifth embodiment of applicant's invention comprises, the compact fluorescent floodlight with a lens designed to precisely control the light emanating from the reflector. Although it could be smooth, the lens is covered with small, detailed shapes to direct the light into the desired beam pattern. The lens also acts as a cover to allow the lamp to act as its own fixture.

A sixth embodiment of applicant's invention comprises, high-intensity discharge lamps with a light emitting source at the focal point of a reflective surface which optimizes the amount of light directed to the TIA. High pressure sodium is one of the most efficient HID sources available today. These lamps are used for general lighting applications where high efficiency and long life are desired while color rendering is not critical. Typical applications include street lighting, industrial hi-bay lighting, parking lot lighting, building floodlighting and general area lighting. The placement of the small light emitting source is determined to be at the focal point of the reflective hemisphere of the outer tube, thereby being determined by said outer tubes diameter.

A seventh embodiment of applicant's invention comprises incandescent lamps with a light emitting source at the focal point of a reflective surface, which optimizes the amount of light directed to the TIA. The placement of the small light emitting source is determined to be at the focal point of the reflective hemisphere of the outer tube, thereby being determined by said outer tubes diameter.

DETAILED DESCRIPTION OF THE INVENTION

Figure 1:
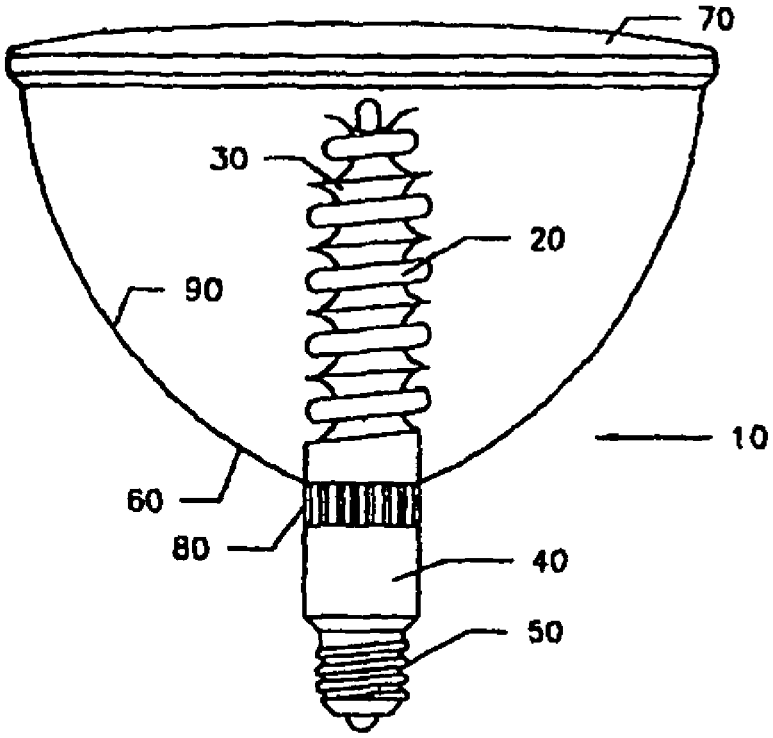
FIG. 1 is a side view of the first embodiment showing a spiral compact fluorescent tube at the focal point of a primary reflector proximate thereto and positioned at the focal point of a secondary reflector, in a configuration commonly referred to as a "floodlight;"

As seen in FIG. 1, a flood light 10 comprises a spiral compact fluorescent lamp 20 around which a primary reflector 30 is positioned. A first bonding means, such as glue or other adhesive or mechanical means is employed to fix lamp 20 and primary reflector 30 in a predetermined position. Lamp 20 is constructed in accordance with typical fluorescent lamps, comprising phosphor coating applied to the inside of the tube with hot cathodes at each end of the lamp. Air is exhausted through the exhaust tube during manufacture and an inert gas is introduced into the bulb. A minute quantity of liquid mercury is included with gas, the gas is usually argon. The stem press has lead-in-wires connecting the base pins and carry the current to and from the cathodes and the mercury arc. Reflector 30 may be fashioned from a variety of materials including but not limited to chrome-plated glass, chrome-plated metal, polished or painted aluminum plate, painted glass, and painted plastic with a variety of reflective coatings. When utilizing molded metal for reflector 30, "mirro 4," "mirro 27" or white reflective aluminum may be selected. Commonly configured, a ballast housing 40, contains a ballast of either electrical or magnetic type, said ballast having a connecting means for electrical connection to lamp 20 and screw plug 50. A second bonding mean is necessary to attach housing 40 to lamp 20. While a bonding means in specified, other means, mechanical or otherwise, may be employed. In addition, ballast housing 40 and screw plug 50 could be fashioned as one unit rather than as separate structures, said unit having either glass, plastic, ceramic or other typical construction known in the art. The area of ballast housing 40 through screw plug 50 is typically fashioned from brass. A secondary reflector 60 in combination with a lens 70 encloses the lighting apparatus. Lens 70 can be made of glass or plastic. Fins 80 are provided on ballast housing 40 to assist in the dissipation of heat.

Secondary reflector 60, in the preferred embodiment, is of paraboloid shape, with its inner surface having a reflective coating 90 said reflector may be fashioned typically from glass, plastic, or metal.

Figure 2:
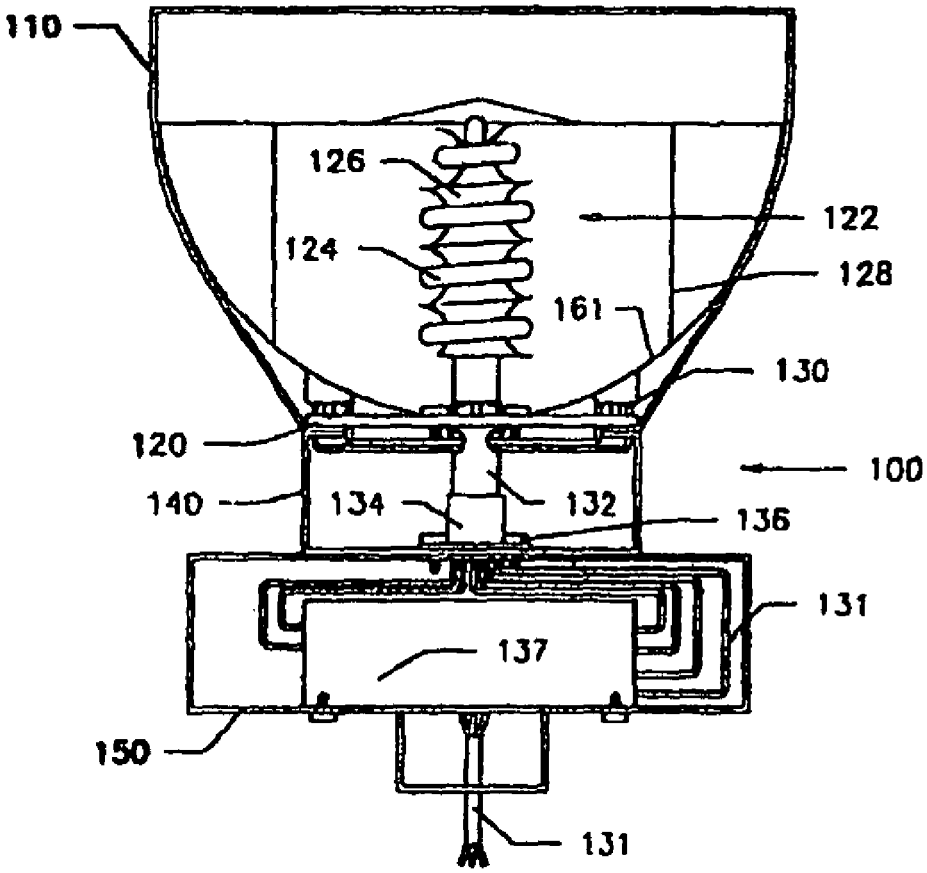
FIG. 2 is a side view of the second embodiment of applicant's invention, disclosing a plurality of spiral fluorescent tubes having primary reflectors positioned as an array and having also secondary reflectors, said array positioned in a third reflector each at its focal point.

FIG. 2 discloses an embodiment 100 of applicant's invention which is primarily employed as a retrofit of existing high bay fixtures. The common housing 110 provides a dual function as a support for a frame 120, said frame fashioned to hold an array 122 of fluorescent lamps 124 having primary reflectors 126. Array 122 further comprises a secondary reflector 128 commonly of assembled sections. Assembled sections are put into third reflector 161. Electrical connections 130, to which electrical wires 131 are attached, are positioned below frame 120 and are fed through a platform 132 and through a transition piece 134, to a fastening means 136. Fastening means 136 fixes secondary housing 140 and therefore housing 110, to a ballast housing 150, through which the electrical wires 131 again pass. These electrical wires may be hard wired to a lighting circuit.

When utilizing embodiment number two for retrofitting a typical high bay fixture such as that disclosed in U.S. Pat. No. 6,068,388 (See sheet 1 of 6), the capacitor and igniter in part 12 are replaced with a ballast. The wiring is kept along with the structure there above. The core and coil which housed in the space adjacent to part 12 is removed. Part 12 may be then fastened to secondary housing 18, each of which can be utilized in addition to reflector 21. All other numbered parts are replaced by those items listed above and below and shown in FIG. 2 and FIG. 3.

A typical high bay fixture can be retrofitted, the capacitor and igniter are replaced with an appropriate capacitor and igniter for a lower wattage high pressure sodium, metal halide, or mercury vapor lamps. The wiring is kept along with the structure thereabove. The core and coil which is housed in the space adjacent to part 12 shown above in U.S. Pat. No. 6,068,388 is replaced with the appropriate core and coil for the lower wattage lamp. All other numbered parts are replaced by those items listed below as shown in FIG. 2 and FIG. 3.

Figure 3:
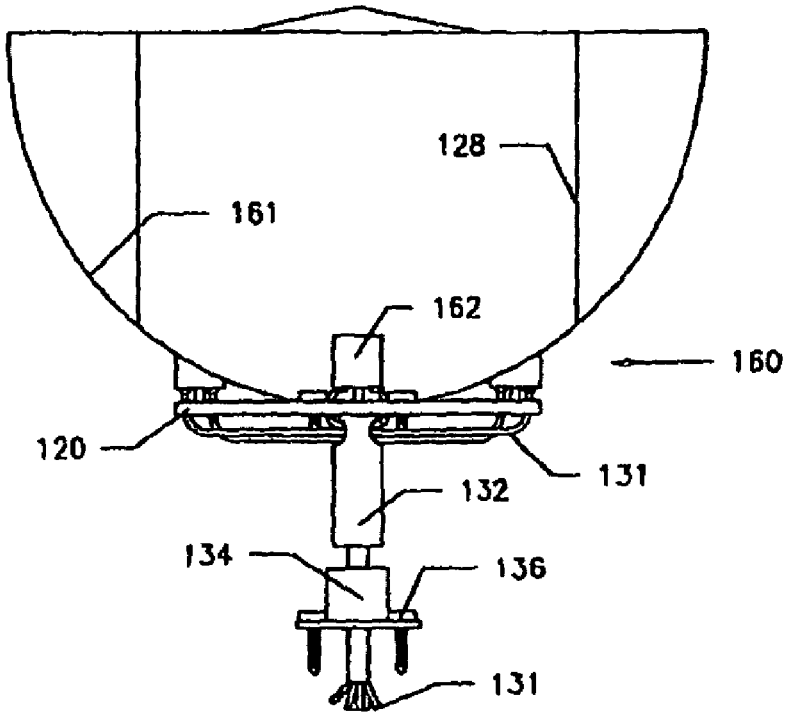
FIG. 3 is a side view of the aforementioned "implant," which may be utilized with a variety of light sources such as the spiral fluorescent tube with primary reflector and beyond, and which may be used to retrofit existing high bay fixtures.
Figure 4:
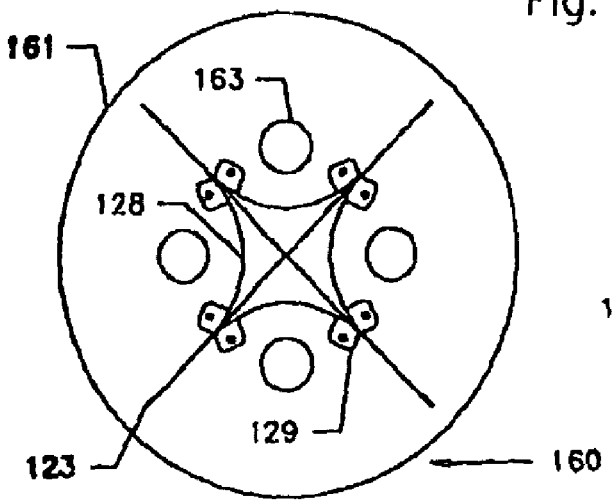
FIG. 4 is a top view of the invention of FIG. 3, further showing the orientation of secondary and third reflectors.

FIG. 3 discloses "implant" 160, described above, provided also with a third reflective mirror-like surface 161. The third reflector could also be used as a secondary reflector 161 in cases where existing technology lamps are used. The implant may be set into an existing high bay enclosure for retrofitting, The height of the implants third reflector depends on condition of reflector 110. Light sockets 162 are provided to accept lamps or other light sources as previously described, and are typically of ceramic construction. As seen in FIG. 4, access holes 163 are provided in reflector 161, allowing for the installation of light source 122, also facilitating the passage of air through holes 163.

Figure 5:
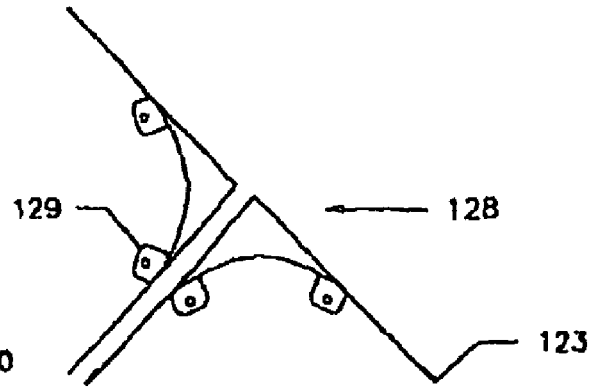
FIG. 5 is a top view of the secondary reflector of the invention disclosed in FIG. 3.

FIG. 5 further discloses secondary reflector 128, and tabs 129, used to fasten the reflector to reflector 161 of FIG. 4, typically by rivets or equivalent means. Folded metal slips 123 slip reflectors 128 together.

Figure 6:
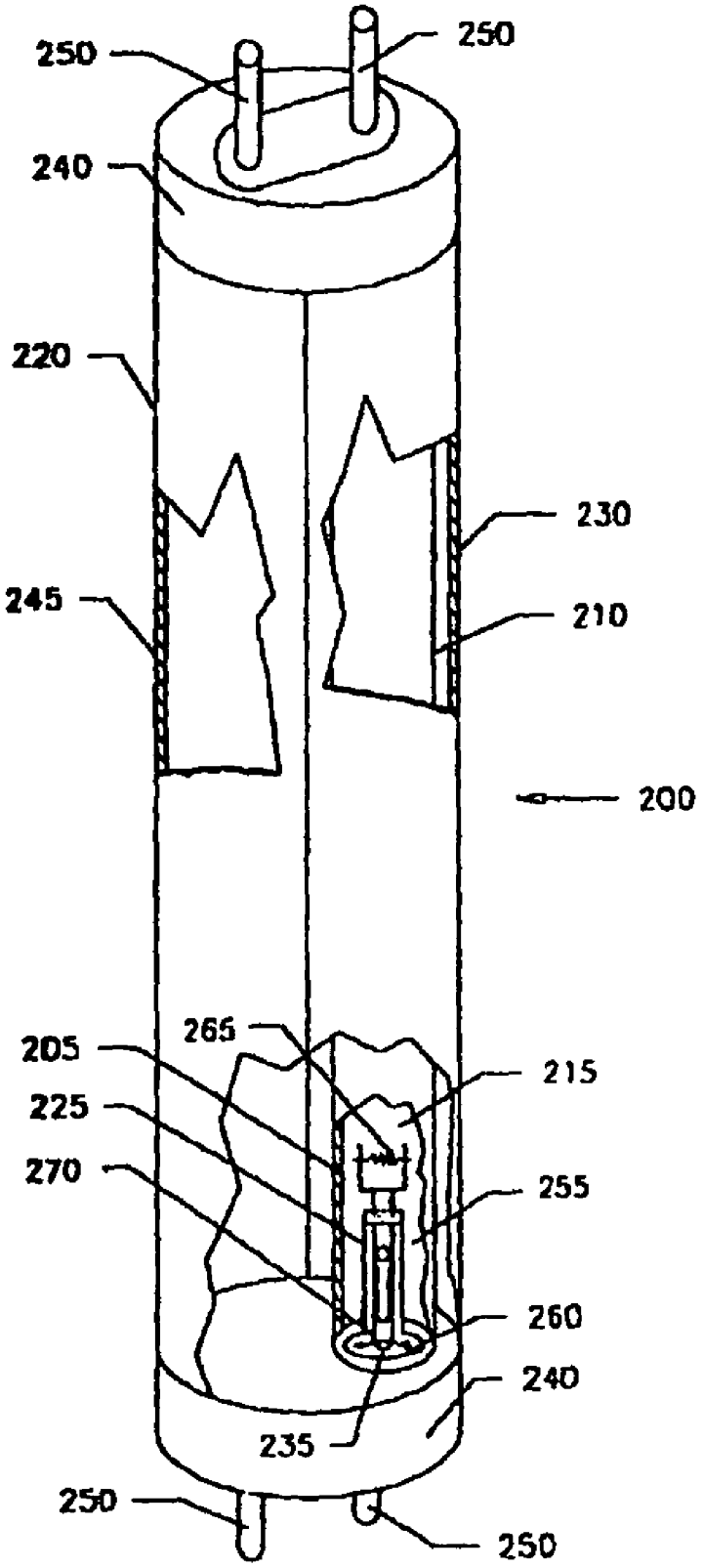
FIG. 6 is a side view of the fifth embodiment of applicant's invention, disclosing a smaller fluorescent tube proximate to the focal point of a larger cylindrical enclosure having a reflective hemisphere and manufactured as one piece.

FIG. 6 shows what appears on the surface to be a standard fluorescent tube. However, FIG. 6 depicts a lighting apparatus 200, which comprises a first fluorescent tube 210. First fluorescent tube may include a bulb 255 with Phosphor coating inside the bulb 255. Cathodes 265 at each end of lamp are coated with emissive materials which emit electrons. Air is exhausted through a tube 270 during manufacture and a minute quantity of liquid mercury 205 is place in the bulb to furnish mercury vapor. Gas 215, usually comprises Argon or a mixture of inert gases at low pressure, but Krypton is sometimes used. Stem Press 225 includes lead-in wires that have an air tight seal here and are made of specific wire to assure about the same coefficient of expansion as the glass. Lead-in wires 235 connect to the base pins and carry the current to and from the cathodes and the mercury arc. The first fluorescent tube 210 housed in a larger cylindrical housing 220. Housing 220 is usually a straight glass tube, but may also be circular or U-shaped, and may be made of plastic, glass or other suitable material. Housing 220 has a reflective hemisphere 230, at the focal point of which is located tube 210, serving as a primary reflector. Several different types of base 240 used to connect the lamp to the electric circuit and to support the lamp in the lamp holder serve to position tube 210 in proper position in housing 220, and further provide penetrations whereby pins 250 may be in electrical contact with the circuitry 260 of tube 210. Of course, the primary reflective surface of hemisphere 230 is provided on the inside or outside of housing 220, which provides reflective capability for light emitted from tube 210. Lens 245 may be smooth, but could be designed to precisely control the light from the reflector. It is covered with small, detailed shapes to direct the light into the desired beam pattern. The lens also acts as a cover to allow the lamp to act as it own fixture. A common material for lens 245 can be glass or plastic or other suitable materials. Reflector 230 could also not be enclosed to save on material costs.

Lighting apparatus 200 depicted in FIG. 6 may be manufactured as one unit or the different elements of lighting apparatus 200 may be used separately with an adapter. The benefit of these separate elements is that standard "T5" units or equivalent fluorescent lamps can be replaced, but the other parts will continually last and not need replacement.

For example, base 240 and pins 250 may be in electrical contact with the circuitry of a tombstone. The tombstone positioned at the focal point of the base hemisphere 240 can hold the smaller pins used in T5 fluorescent lamps. Several different types of lamp pins maybe used to connect lamp 210 and the tombstone. Common materials for the adaptor tombstone, pins, and connectors—could be metal, ceramic, plastic, or the equivalent.

Housing 220 of FIG. 6 may be provided in a number of suitable configurations, including a larger cylindrical housing. Housing 220 has a reflective hemisphere 230 with lens cover 245. Some common materials that could be used for housing 220 may be glass or plastic, or other suitable materials commonly employed in the art.

The fluorescent tube may also be combined with bases 240, pins 250, and fluorescent tube 210 as one unit.

Additionally or alternatively, lighting apparatus 200 may include enclosure caps and end caps with slots to hold pins 250 in place. Lighting apparatus 200 may also be employed in a secondary reflector, such as a wash board type reflective housing, thereby giving additional reflective assistance in delivering light to a target illumination area.

In lighting apparatus 200 depicted in FIG. 6 and disclosed hereinabove, standard type electrical connections including ballasts, sockets, and standard wiring are employed. Applicant's invention focuses primarily on the reflective aspects of providing additional light to a TIA, resulting in more lighting where desired with conservation of energy.

Figure 6A:
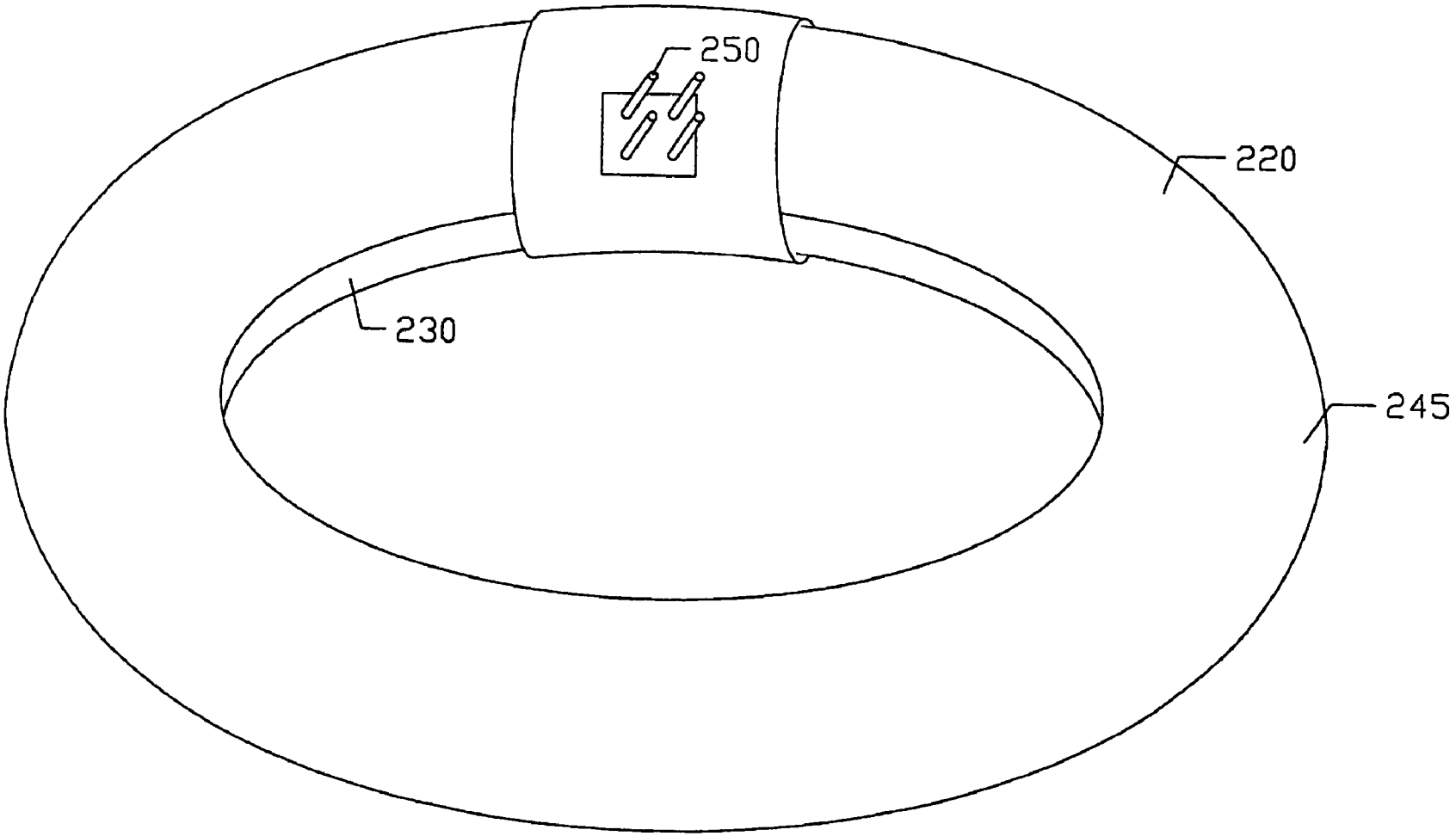
FIG. 6A is a side view of the lighting apparatus of FIG. 6 having a tubular housing of a circular shape.
Figure 6B:
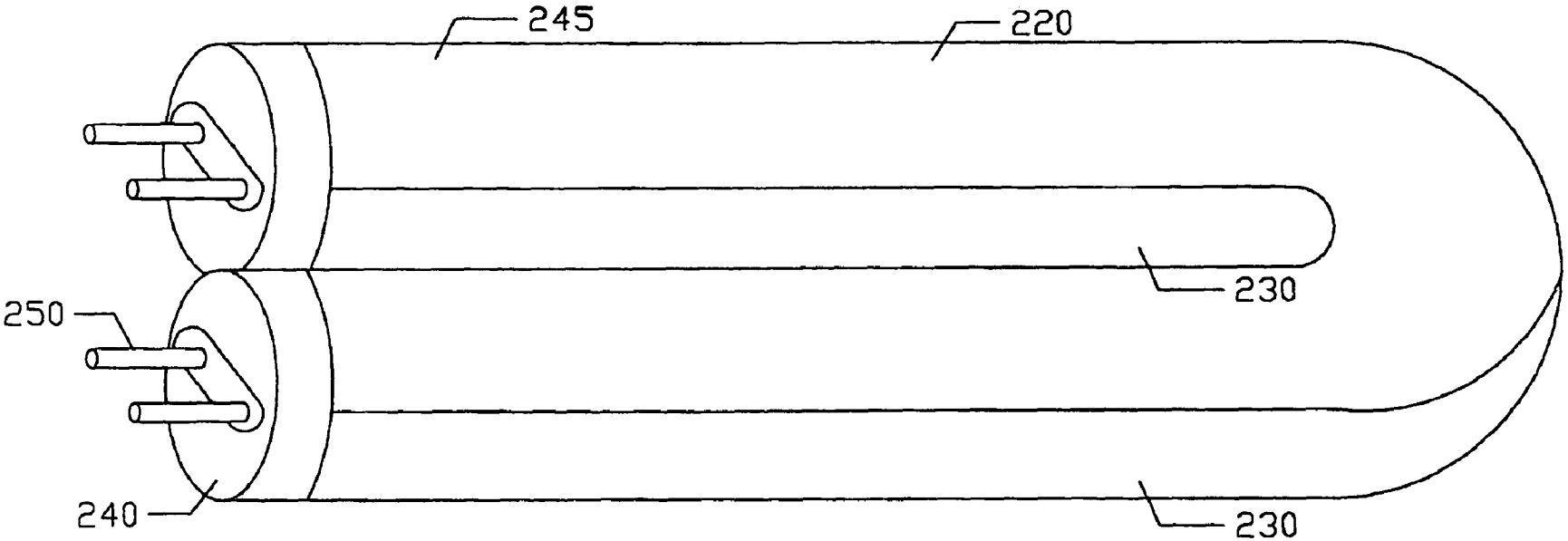
FIG. 6B is a side view of the lighting apparatus of FIG. 6 having a tubular housing of a U-shape.

FIGS. 6A and 6B depict the housing 220 shown in FIG. 6 in circular and U-shapes, respectively, as discussed above.

Figure 7:
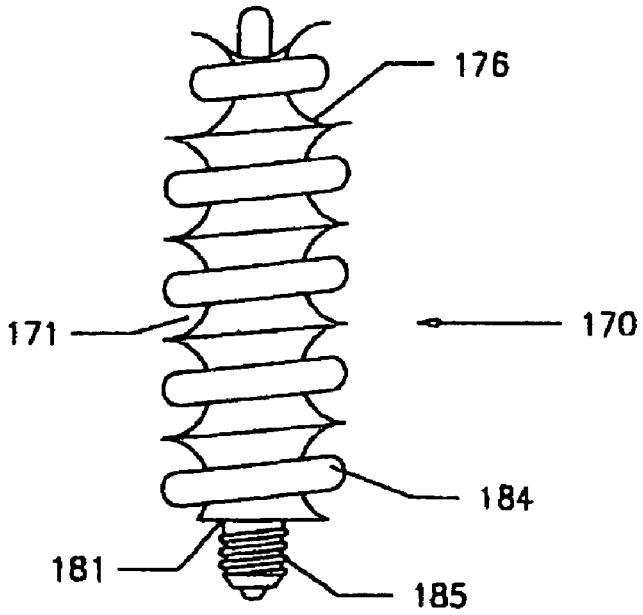
FIG. 7 is a side view of the aforementioned spiral compact fluorescent or fluorescent lamp, disclosing a smaller fluorescent spiral tube proximate to the focal point of a larger concave spiral reflector.

FIG. 7 discloses spiral compact fluorescent (or fluorescent lamp) 170 comprising a spiral compact fluorescent lamp 184 around which a primary reflector 176 is positioned. A first bonding means, such as glue or other adhesive or mechanical means is employ to fix lamp 184 and primary reflector 176 in a predetermined position. Ballast housing 181 for compact fluorescent lamp (or no ballast housing 181 for fluorescent lamp without ballast). In addition, housing 181 and screw plug 185 could be fashioned as one unit rather than as separate structures. Also air space 171, as heat dissipates cool air is drawn into space 171 cooling housing 181 and reflector 176.

Figure 8:
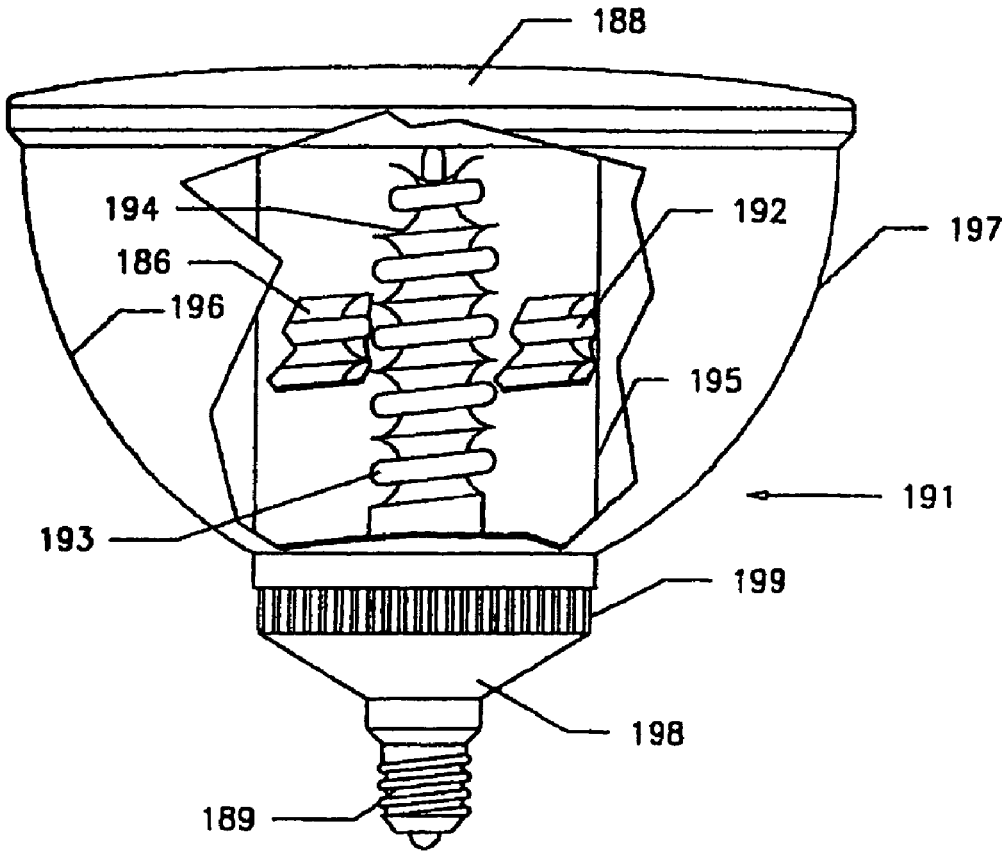
FIG. 8 is a side view of the aforementioned "HID" compact fluorescent lamp with an array of spiral fluorescent tubes with primary, secondary and third reflectors in a configuration commonly referred to as a "floodlight;"

FIG. 8 discloses the "HID" fluorescent lamp 191, of applicant's invention which is primarily employed as a retrofit of existing high bay fixtures. HID fluorescent lamp 191 holds an array 192 of fluorescent lamps 193 having primary reflectors 194. The array 192 further comprises a secondary reflector 195 commonly of assembled sections or one molded piece slips into a third reflective mirror-like surface 196 which is coated with a reflective material. The paraboloid shape housing 197 is made up of material like glass or plastic or other suitable equivalents. A variety of reflective materials may be used for reflectors 194, 195, and 196 including but not limited to chrome-plated glass, chrome-plated metal, polished or painted aluminum plate, painted glass, and plastic painted with a variety of reflective coatings. When utilizing molded metal for reflectors 194, 195, and 196 "mirro 4", "mirro 27" or white reflective aluminum may be selected. A first bonding means, such as glue or other adhesive or mechanical means is employed to fix lamp array 192 and primary reflector array 186 in a predetermined position relative to secondary 195 and third 196 reflectors housing. Commonly configured, a ballast housing 198, contains a ballast of either electrical or magnetic type, said ballast having a connecting means for electrical connection with lamp 193 and screw plug 189. A second bonding means is necessary to attach housing 198 to housing 197. Fins 199 are provided on ballast housing 198 to assist in dissipation of heat. A smooth lens 188 or a lens 188 designed to precisely control the light from the reflector is provided. Lens 188 covered with small, detailed shapes to direct the light into the desired beam pattern. The lens also acts as a cover to allow the lamp to act as its own fixture.

Figure 9:
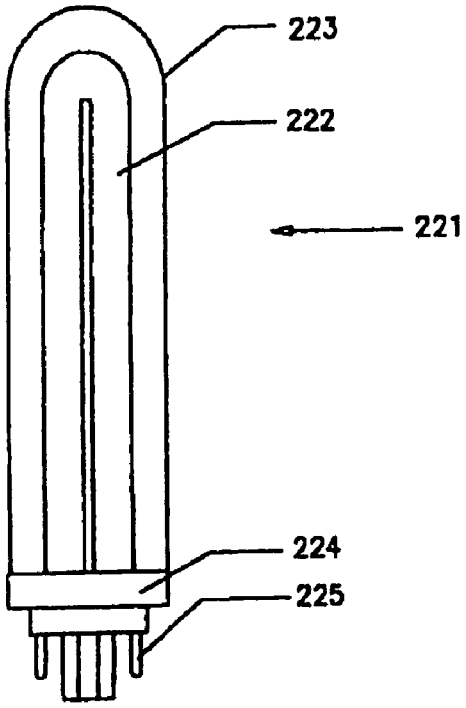
FIG. 9 is a side view of the invention, disclosing a smaller U-shaped fluorescent tube proximate to the focal point of an enclosed partially reflective tube or concave open reflector.

FIG. 9 shows a U-shaped fluorescent lamp 221 with tube 222 in a predetermined positioned of reflective surface 223. Tube 222 and reflector 223 are bonded to base 224 by glue or other mechanical means. Pin 225 and base 224 can be manufactured as one unit or as separate pieces. Many types of base 224 are used on the open market.

Figure 10:
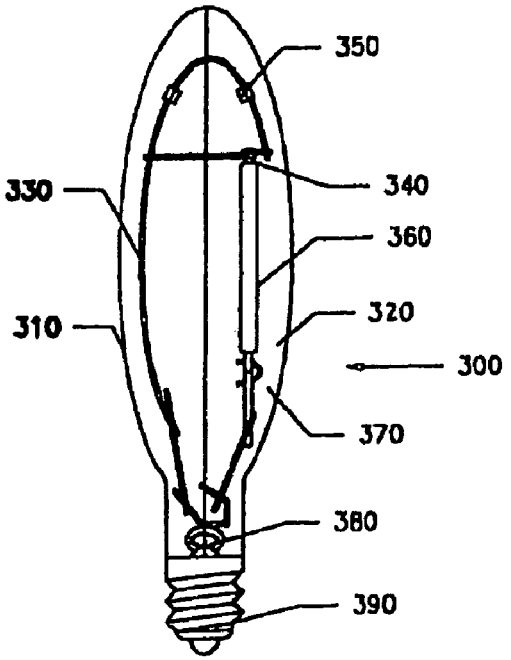
FIG. 10 is a side view of the invention, disclosing the HID high pressure sodium lamp with part of the glass envelope having reflective surface.

FIG. 10 discloses a high pressure sodium Lamp ("HPS") 300 comprising a glass envelope 310 having a substantially concave reflective surface 320. An arc tube 340, with hermetic end seal 360, typically an alumina arc tube or equivalent, is located proximate to the focal point of reflector 320 via a frame 330, usually steel. A residue gas repository 380 is positioned in lamp 300 on a base 390, where it is affixed in its location, and serves to support frame 330. Brass base 390 secures lamp 300 to a suitable light fixture and connects the light fixture's electric circuitry to the lamp. This lamp is made up of glass, metals, or other suitable materials commonly employed in the art.

Figure 11:
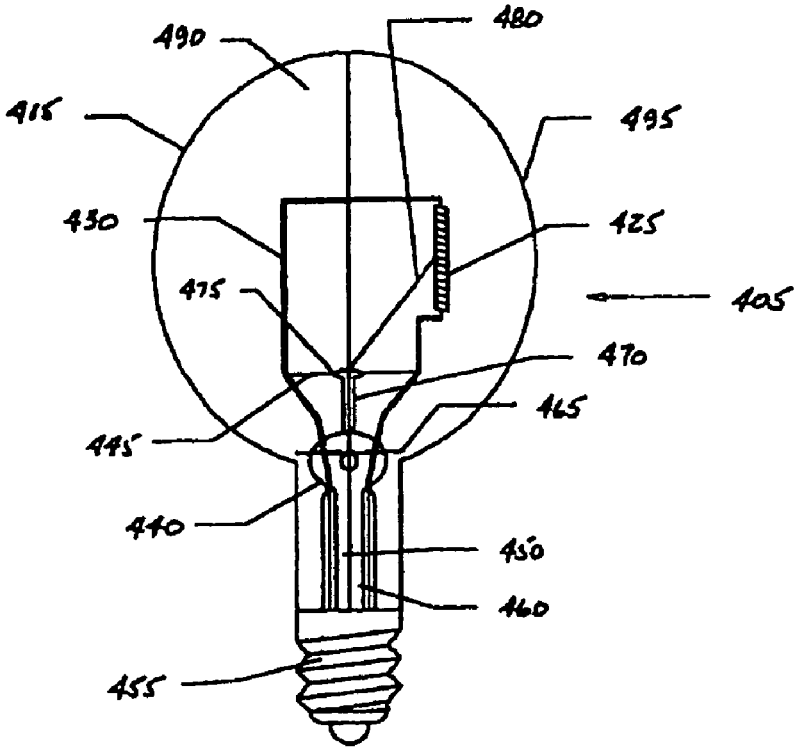
FIG. 11 is a side view of the invention, disclosing an incandescent lamp with part of the glass bulb as a reflective surface.

FIG. 11 shows an incandescent lamp 405 comprising a soft glass envelope 415. Filament 425, generally tungsten is electrically connected by wires 430 to a glass stem press 440. Wires 430 are made typically of nickel-plated copper or nickel from stem press 440 to filament 425. Tie wires 445 support wires 435 in the largest envelope area. Wires 430 pass through stem press 440, and an air evacuation tube 450 toward a base 455. In this stem press area, wires 430 transition from nickel-plated copper or nickel to a nickel-iron alloy core and a copper sleeve (Dumet wire). In this area, there exists an air tight seal at the termination of tube 450, said wires' material change made to assure about the same coefficient of expansion of the wires as the glass, and air exhaust tube 450. Base 455 is made of brass or aluminum. A fuse 460 protects the lamp and circuit if filament 425 arcs. A heat deflector 465 is used in higher wattage general service lamps and other types when needed to reduce circulation of hot gases into neck of bulb.

Glass button rod 470 projects from stem press 440 and supports button 475. Button 475 has affixed thereto support wires 480 and 485. Gas 490 a mixture of nitrogen and argon is used in most lamps 40 watts and over to retard evaporation of the filament 425. A coating is applied to glass envelope 415, creating a substantially sphere-shaped reflective surface 495. Filament 425 is located proximate to the focal point of surface 495. The lamp is made of material like glass or plastic or other suitable equivalents.

Figure 12:
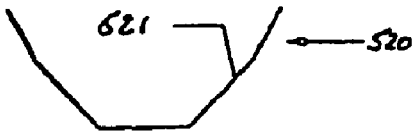
FIG. 12 is a side view of the aforementioned "reflector", disclosing a concave reflector.

FIG. 12, discloses reflector 500, a concave reflector 501, made of a variety of reflective materials including but not limited to chrome-plated glass, chrome-plated metal, polished or painted aluminum plate, painted glass, and plastic painted with a variety of reflective coatings. When utilizing molded metal for reflector 500 "mirro 4", "mirro 27" or white reflective aluminum may be selected or other suitable equivalents.

Figure 13:
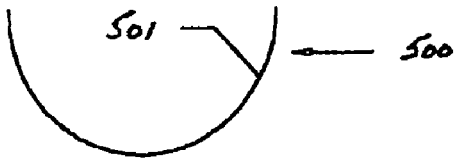
FIG. 13 is a side view of the aforementioned "reflector", disclosing a W-Shape reflector.

FIG. 13, discloses reflector 510, a W-shape reflector 511, again fashioned from a variety of reflective materials as mentioned in FIG. 12.

Figure 14:
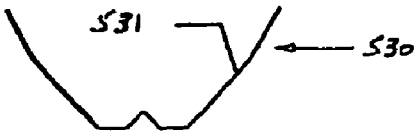
FIG. 14 is a side view of the aforementioned "reflector", disclosing a wash board reflector.

FIG. 14, discloses reflector 520, and a wash board shape reflector 521, again made from a variety of reflective materials as mentioned in FIG. 12.

Figure 15:
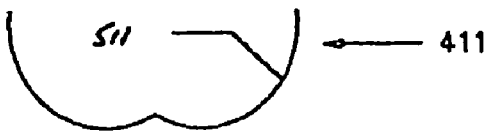
FIG. 15 is a side view of the aforementioned "reflector", disclosing a wash board shaped reflector.

FIG. 15, discloses reflector 530, and a wash board shape reflector 531, both made from a variety of reflective materials as mentioned in FIG. 12.

Figure 16:
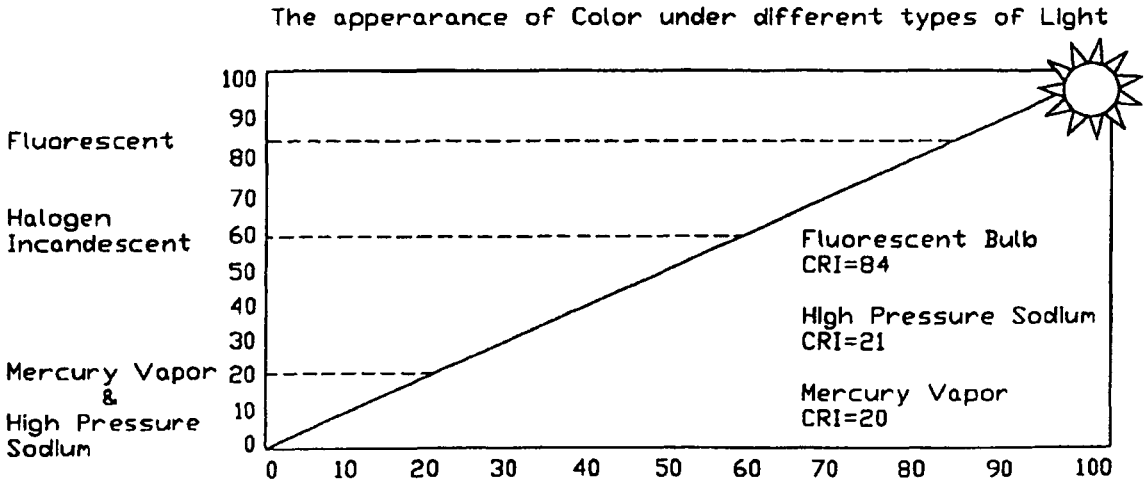
FIG. 16 is a graph showing the appearance of color under different types of light.

FIG. 16 is a graph showing the appearance of color under different types of light.

Figure 17:
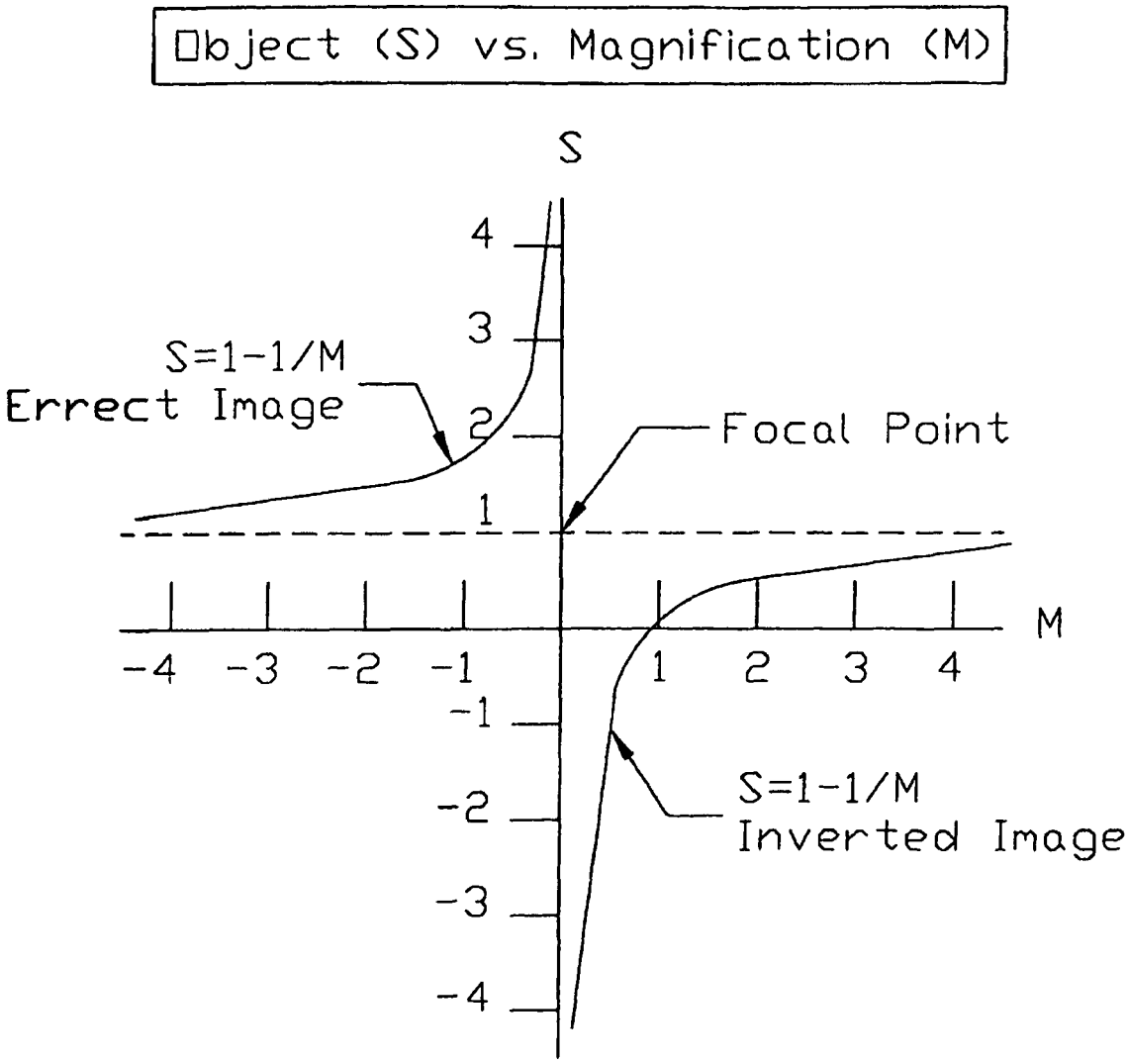
FIG. 17 is a graph showing the relationship between an object and magnification.

FIG. 17 is a graph showing the relationship between an object and magnification.

Figure 18:
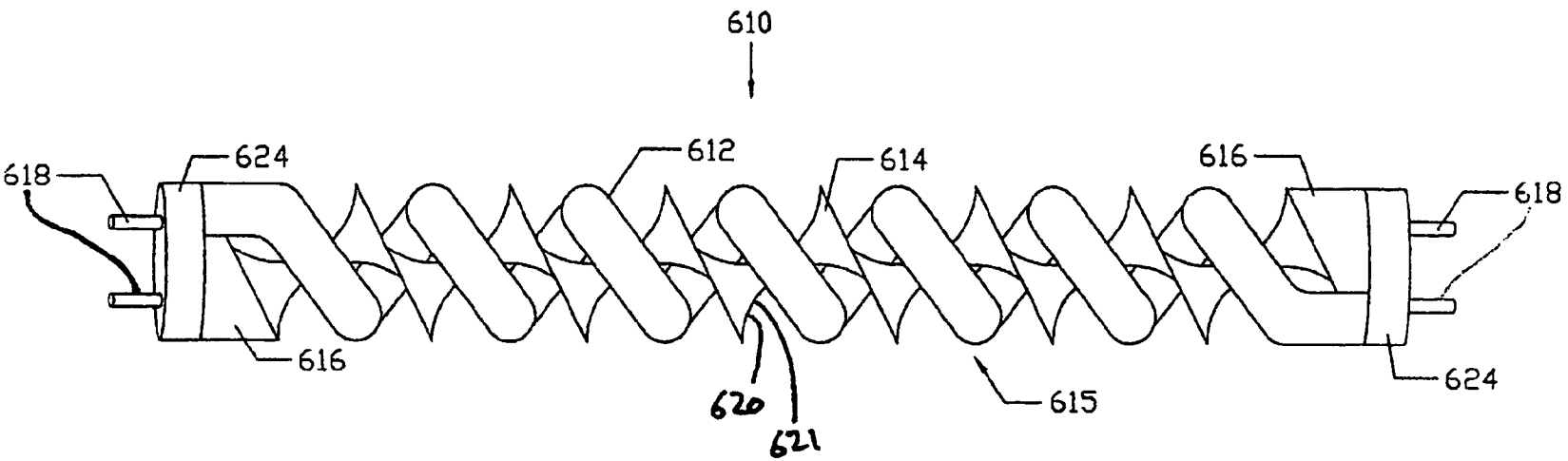
FIG. 18 is a side view of an illumination device with a light source coiled around a primary reflector.
Figure 19:
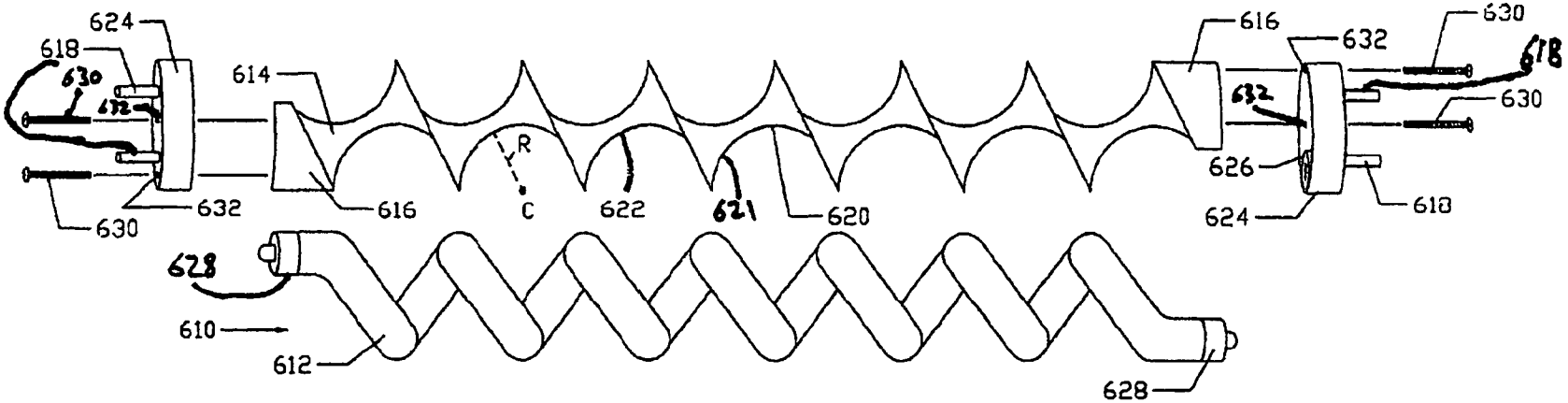
FIG. 19 is an exploded view of the illumination device of FIG. 18.
Figure 20:
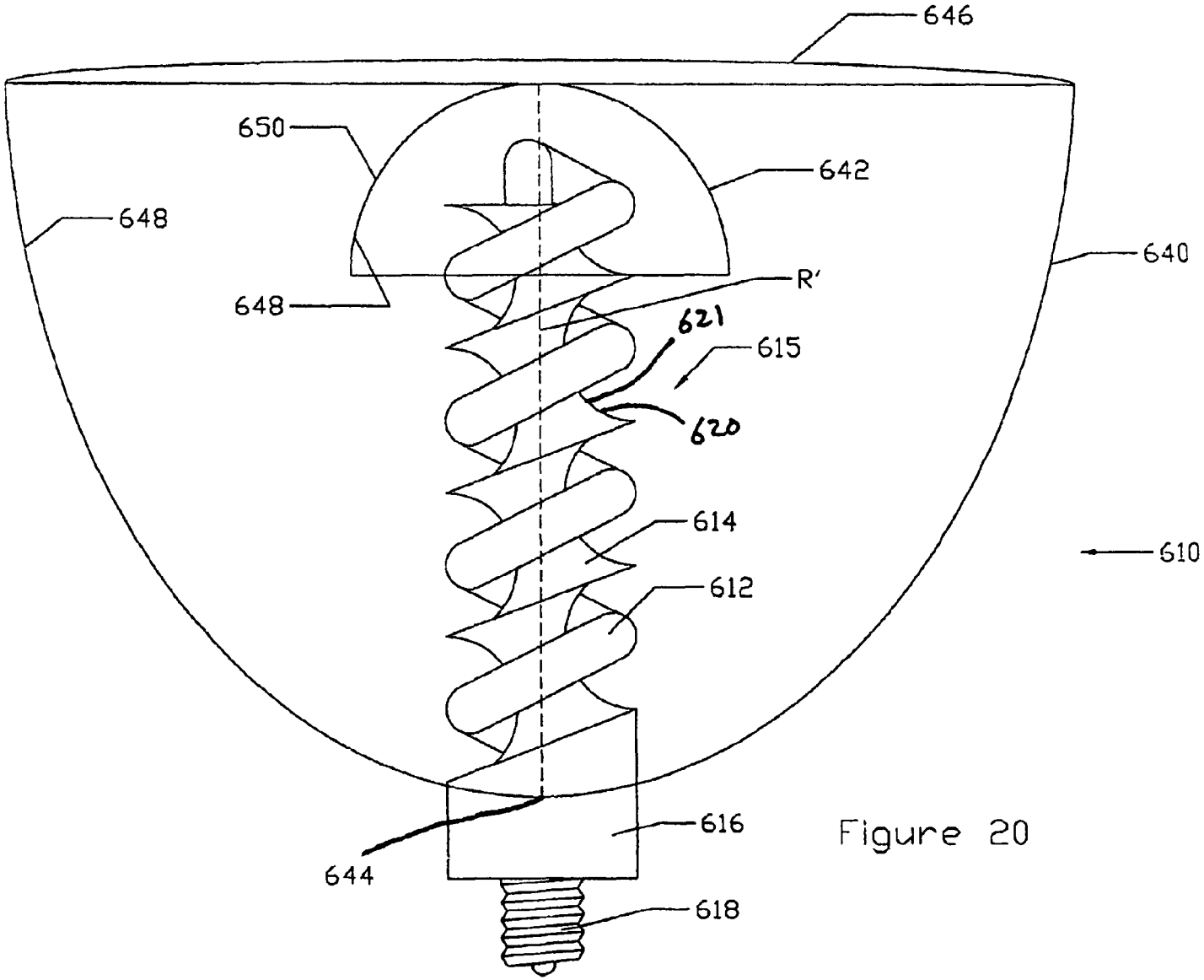
FIG. 20 is a side view of the illumination device of FIG. 18 having a secondary reflector and a tertiary reflector.

As shown in FIGS. 18-20, an illumination device 610 may include a light source 612, such as a fluorescent light, coiling around a primary reflector 614 in a helical fashion. The combination of light source 610 and primary reflector 614 may define a light reflection unit 615. Light reflection unit 615 is typically mounted to one or more bases 616.

Bases 616 may include electrical contacts 618 for electrically coupling with an external power supply. Electrical contacts 618 may take the form of any suitable type of electrical contact known in the art, such as electrically conductive pins as pictured in FIGS. 18 and 19, or a screw base connector as pictured in FIG. 20. Base 616 may house a ballast (not pictured) for regulating current flow through light source 612.

As shown most clearly in FIG. 19, primary reflector 614 may include a helical groove 620 having reflective properties. Helical groove 620 may have an interior curve forming a curved channel 621 with a helical groove apex 622. Helical groove apex 622 is the minimum (or maximum depending on the frame of reference) point along curved channel 621. The interior curve of helical groove 620 may define an effective radius R extending from helical groove apex 622 to an imaginary center C of what would be an approximate circle were curved channel 621 to extend further along its curved path. Light source 612 may be spaced apart radially from primary reflector 614 half the distance of effective radius R, which may correspond to the focal point of light reflected from primary reflector 614.

As shown in FIGS. 18 and 19, bases 616 may be fitted with endcaps 624. In some examples, illumination device 610 may include two or more endcaps 624. In the example shown in FIG. 19, fasteners 630, such as screws, secure endcaps 624 to bases 616 through apertures 632.

Each endcap 624 may include a tombstone 626 in which mating members 628 of light source 612 may insert to electrically couple light source 612 with a power supply. Tombstone 626 may be a "tombstone" style electrical connector as known in the art for facilitating electrical communication between light source 612, such as a fluorescent light, and electrical contacts 618. In the examples shown in FIGS. 18 and 19, electrical contacts 618 comprises electrically conductive pins extending from each endcap 624. The electrically conductive pins are typically configured to mate with a complimentary electrical socket linked to a power supply. Tombstone 626 may be in electrical communication with electrical contacts 618 via a ballast (not pictured), which may regulate the current flow through light source 612, such as a fluorescent light.

In some examples, such as shown in FIG. 20, illumination device 610 may include a secondary reflector 640 and/or a tertiary reflector 642. In some examples, illumination device 610 may include secondary reflector 640 without tertiary reflector 642 or vice versa. Secondary reflector 640 and tertiary reflector 642 each compliment the reflective properties of reflector 614 by redirecting light from light reflection unit 615 towards a target illumination area. However, neither secondary reflector 640 nor tertiary reflector 642 is required and one may be used without the other.

Secondary reflector 640 may generally be in the shape of a paraboloid with a secondary reflector apex 644 opposite an opening 646. Secondary reflector 640 may take additional or alternative shapes such as pyramidal, tubular, or an irregular shape. An interior surface 648 of secondary reflector 640 may have reflective properties. As shown in FIG. 20, secondary reflector may include an effective paraboloid radius R' extending from secondary reflector apex 644 to opening 646.

Secondary reflector apex 644 defines an effective minimum (or maximum depending on the frame of reference) region in the paraboloid shape. Secondary reflector apex 644 may include an apex aperture (not pictured) through which base 616 may extend. Secondary reflector 640 typically attaches to base 616 at secondary reflector apex 644 to yield certain reflective properties from the shape of secondary reflector 640. In the example shown in FIG. 20, the curved shape of secondary reflector 640 may direct light from light reflection unit 615 to a target illumination area.

Tertiary reflector 642 may also have a paraboloid shape with a tertiary interior surface 648 having reflective properties. However, tertiary reflector 642 may take additional or alternative shapes such as pyramidal, tubular, or an irregular shape. Tertiary reflector 642 may also have an exterior surface 650 having reflective properties. In the example shown in FIG. 20, light entering tertiary reflector 642 is reflected downward onto secondary reflector 640. Upon reaching secondary reflector 640, the light may then be reflected towards a target illumination area.

In all embodiments disclosed hereinabove, standard type electrical connections including ballasts, sockets, and standard wiring are employed. Applicant's invention focuses primarily on the reflective aspects of providing additional light to a target illumination area, resulting in more lighting where desired with conservation of energy.

Figure 21:
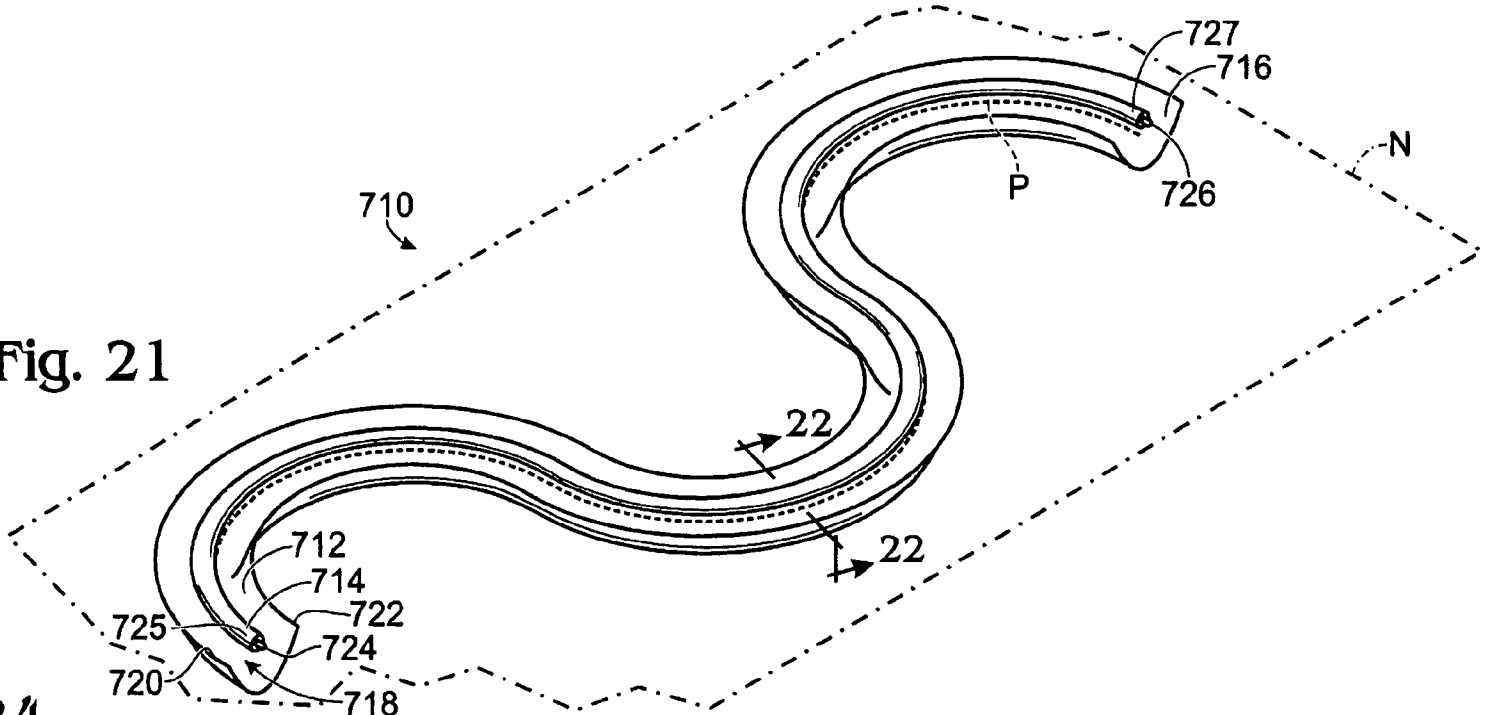
FIG. 21 is a perspective view of an illumination device including a reflector having a curved path.

A further example of an illumination device 710 is shown in FIG. 21. As shown in FIG. 21, illumination device 710 may include a primary reflector 712 and a light source 714 spaced from primary reflector 712. As a point of reference, primary reflector 712 in FIG. 21 may be described as extending longitudinally in a plane P. Additionally or alternatively, primary reflector 712 may extend in three dimensions. Illumination device 710 may be suitable for providing illumination a variety of residential, commercial, and industrial settings.

Figure 22:
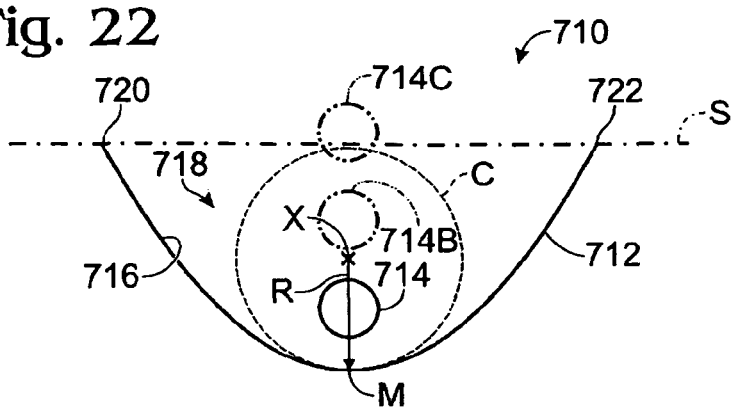
FIG. 22 is a side elevation view of a cross section of the FIG. 21 illumination device taken along line 22-22 in FIG. 21.

As shown in FIGS. 21 and 22, primary reflector 712 may include an exterior surface 716. In some examples, exterior surface 716 reflects light, such as reflecting light towards a first target illumination area. Exterior surface 716 itself may be mirrored or otherwise have reflective properties. Additionally or alternatively, a layer of reflective material or a reflective coating may be supported by exterior surface 716. For example, exterior surface 716 may be a substrate including a metallic coating having light reflective properties.

Exterior surface 716 may define a curved path P as shown in FIG. 21. A wide variety of curved paths are envisioned. For example, a random curved path P extending longitudinally is shown in FIG. 21. An exterior surface 716A shown in FIG. 23 defines a spiral curved path. Helical curved paths are shown generally in FIGS. 1, 2, 7, 8, and 18-20, a circular curved path is shown generally in FIG. 6A, and U-shaped curved paths are shown generally in FIGS. 6B and 9. Other curved paths (not pictured) may include sinusoidal and oblong portions.

Exterior surface 716 may be curved in a plane transverse to the reference plane N. For example, as can be seen in FIGS. 21 and 22, a cross section of exterior surface 716 taken transverse to curved path P may be curved in the shape of a parabola. The curvature of exterior surface 716 may alternatively be described as being latitudinal relative to the longitudinally extending curved path P. Any or all two-dimensional sections of exterior surface 716 along curved path P may be curved in some manner. Alternatively, one or more sections may not be curved.

Exterior surface 716 may partially enclose an interior space 718. Interior space 718 may be the space bounded by exterior surface 716 and an imaginary surface S shown in FIG. 22. Imaginary surface S is shown in FIG. 22 to extend between a first edge 720 of exterior surface 716 and a second edge 722 of exterior surface 716. Imaginary surface S may be a plane, as depicted in FIG. 22, or may be a curved surface complimenting first and second edges 720, 722. For example, imaginary surface S may be curved if the height of the edges 720, 722 varies as curved path P extends longitudinally.

With reference to FIG. 22, the curvature of exterior surface 716 may include a minimum point M and define an effective radius R. The minimum point M may be the point along the curvature of exterior surface 716 in which the curve transitions between ascending or descending or between any other opposed relationship, such as inward and outward. Effective radius R may be the distance between exterior surface 716 and an imaginary center P of an imaginary circle C. Imaginary circle C is a circle that approximately corresponds to or shares a common circumference with a portion of the curvature of exterior surface 716.

Light source 714 of illumination device 710 may be spaced from primary reflector 712 at least partially within interior space 718. As can be seen in FIG. 22, a variety of spacing distances are contemplated. For example, in FIG. 22, light source 714 is shown to be spaced approximately one-half effective radius R from minimum point M of the curved exterior surface 716. The position of light source 714 in FIG. 22 may be referred to as the focal point of exterior surface 716.

As an alternative example, a light source 714B is shown to be spaced greater than the effective radius R from minimum point M of exterior surface 716. Further, a light source 714C is shown to be spaced a distance greater than effective radius R from minimum point M of exterior surface 716. A portion of light source 714C is within interior space 718 and a portion of light source 714C is outside interior space 718.

Spacing light source 714 different distances from exterior surface 716 may be suitable for different applications. For example, different spacing distances may modify the light concentration emanating from illumination device 710. Additionally or alternatively, the spacing may modify the power consumed by illumination device 710 to produce a given amount of illumination. Further, the spacing may modify how heat generated by illumination device 710 is dissipated. In some examples, light source 714 is positioned approximately at the focal point of exterior surface 716 to increase the intensity of light emanating from illumination device 710.

In comparison to light source 714 having a circular cross section as shown in FIG. 22, in some examples, the light source may have oblong cross section (not pictured). In examples where the light source has an oblong cross section, the longer dimension of the oblong cross section may extend along a line extending from minimum point M to center X. Having the longer dimension of the oblong cross section oriented in this manner may fill more of the height of exterior surface 716 with a source of light. As with light source 714 shown in FIG. 22, the light source having an oblong cross section may be spaced a variety of distances from minimum point M.

Light source 714 may include a wide variety of lighting technologies. For example, light source 714 may include fluorescent, incandescent, halogen, xenon, neon, mercury-vapor lights, and gas-discharge lights, as well as light emitting diodes. The light sources shown in FIGS. 21-24 depict fluorescent lights. However, those skilled in the art will understand that fluorescent lights represent only one example of lighting sources that my be used with the presently described illumination devices.

As shown in FIG. 21, light source 714 may extend between a first terminal end 725 and a second terminal end 727 and be curved to compliment curved path P. Light source 714 shown in FIG. 21 may alternatively be described as substantially following curved path P. Thus, light source 714 may be longitudinally curved and extend along exterior surface 716 of primary reflector 716.

For electrically coupling to a power supply (not pictured), light source 714 is shown in FIG. 21 to include a first conductive pin 724 extending from first terminal end 725 and a second conductive pin 726 extending from second terminal end 727. The first and second conductive pins 724 and 725 may couple with a tombstone or other electrical connecter as necessary to electrically couple light source 714 to a power supply.

Figure 24:
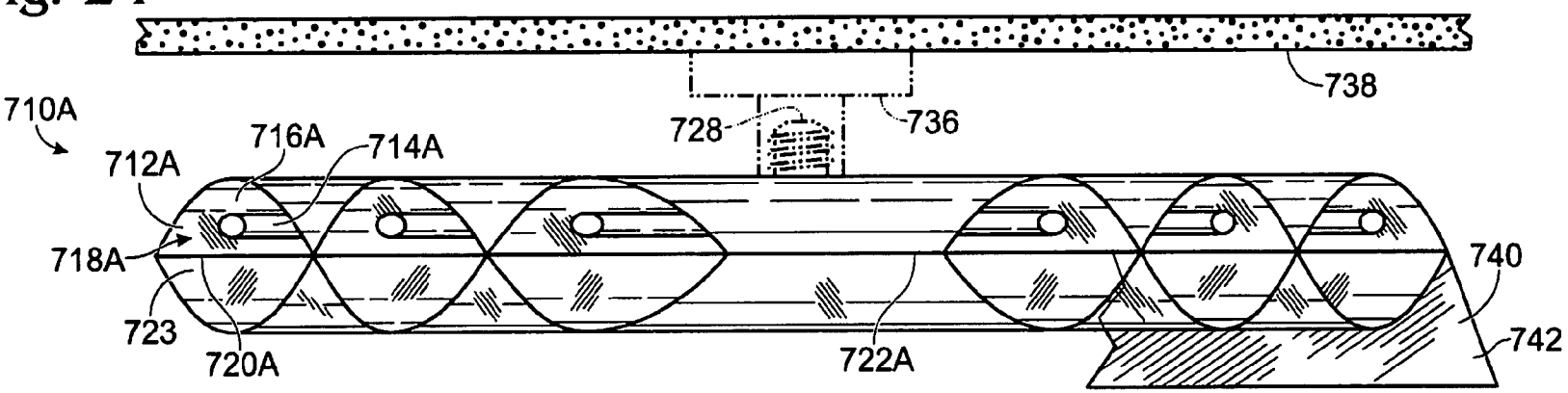
FIG. 24 is a side elevation view of a cross section of the FIG. 23 illumination device example taken along line 24-24 in FIG. 23.
Figure 23:
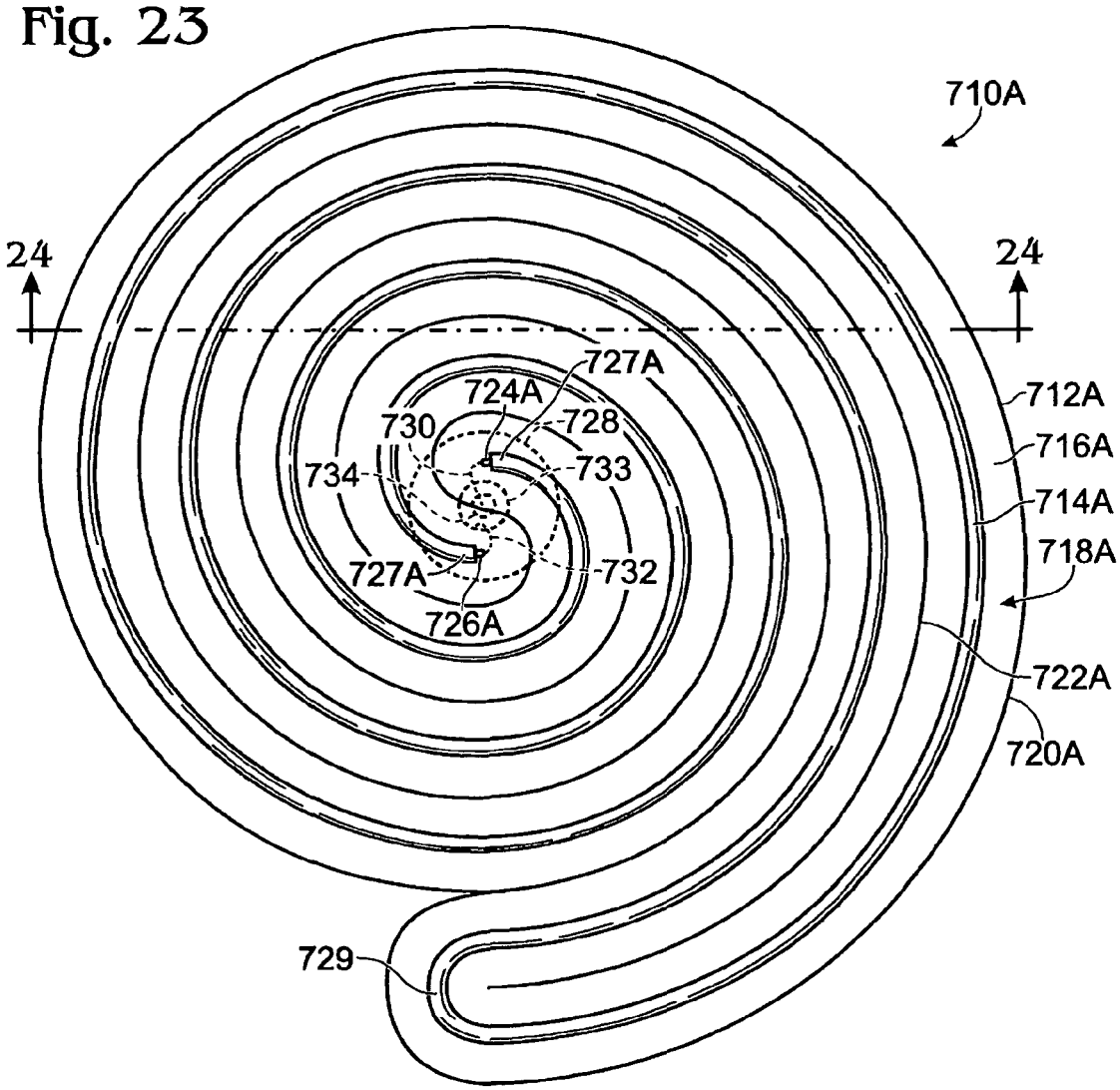
FIG. 23 is a plan view of an underside of an illumination device including a reflector having a spiral curved path.

An alternative illumination device 710A is shown in FIGS. 23 and 24. As shown in FIGS. 23 and 24, illumination device 710A may include a primary reflector 712A at least partially surrounding a light source 714A. Light source 714A may extend between a first terminal end 725A and a second terminal end 727A. Primary reflector 712A may include an exterior surface 716A having reflective properties.

As shown in, FIG. 23, exterior surface 716A may extend in a curved path, such as a spiral curved path. Additionally or alternatively, exterior surface 716A may be curved to at least partially surround light source 714A. The curvature of exterior surface 716A may be concave facing light source 714A and may partially enclose an interior space 718A. The partially enclosed interior space 718A may be defined as the space surrounded by the concave exterior surface 716A and within an imaginary surface extending between a first edge 720A of exterior surface 716A and a second edge 722A of exterior surface 716A.

With reference to FIG. 24, illumination device 710A may include a lens 723 extending between first edge 720A and second edge 722A. Lens 723 may be formed from glass, plastic, or other polymeric material. Permanent, semi-permanent, or selective attachment of lens 723 to primary reflector 712A is contemplated, such as with adhesive, magnetic, snap on, or screw in, attachment means. Lens 723 may be curved, as shown in FIG. 24, or may be flat, angular, or irregular.

Lens 723 may be transparent, translucent, colored, or selectively opaque. Light may be refracted by lens 723 or may pass substantially unaffected through lens 723. Lens 723 may include patterns, designs, or etchings configured to direct light in certain directions or to concentrate light towards certain areas, such as a target illumination area. In some examples, lens 723 may redirect or reflect ambient light towards a target illumination area.

Light source 714A may be spaced a variety of distances from exterior surface 716A. For example, light source 714A may be spaced at the focal point of exterior surface 716A, or may be spaced closer to or farther from exterior surface 716A than the focal point. In some examples, such as shown in FIG. 24, light source 714A is positioned wholly within the interior space 718A, while in other examples, light source 714A is positioned partially within interior space 718A. Further, light source 718A may be positioned wholly outside of interior space 718A in some applications.

As shown in FIG. 23, light source 714A may be bent into a bent configuration that brings first terminal end 725A and second terminal end 727A substantially adjacent to one another. In the bent configuration, light source 714A may include one or more bends 729. Bend 729 may be formed at a midpoint of light source 714A or at any point between first and second terminal ends 725A ,727A. In some examples, exterior surface 716A includes complimentarily bends to correspond with light source 714A in the bent configuration.

As can be seen in FIG. 23, the spiral curved path may include a center portion. First and second terminal ends 725A, 727A may be substantially adjacent to each other at or adjacent to the central portion. Having first and second terminal ends 725A, 727A substantially adjacent at the central portion may obviate the need for tombstones or other electrical connectors. In the bent configuration shown in FIGS. 23 and 24, a common, centrally disposed screw base connector 726 is used to connect both first and second terminal ends 725A, 727A to a power supply (not pictured).

A variety of connectors and connection means may be used to electrically connect light source 714A to a power supply. As shown in FIGS. 23 and 24, light source 714A may include first and second conductive pins 724A, 726A extending from first and second terminal ends 725 and 727, respectively. As mentioned above, an example of a screw base connector 728 is shown in FIGS. 23 and 24. In the example shown in FIG. 24, first and second wires 730, 732 electrically couple first and second conductive pins 724A, 726A with screw base connector 728, respectively.

Screw base connector 728 may include a first connection portion 733 providing a current path for an electrical circuit. Further, screw base connector 728 may include a second connection portion 734 providing a current path for an electrical circuit. First connection portion 733 may provide a current path from a power supply to illumination device 710A and second connection portion 734 may provide a current path to electrical ground or other relatively lower electrical potential destination, or vice versa. As shown in FIG. 23, a first wire 730 may electrically couple first conductive pin 724 with first connection portion 733. Further, a second wire 732 may electrically couple second conductive pin 726 with second connection portion 734.

As shown in FIG. 24, screw base 738 may couple with a fixture 736 that mounts to a mountable surface 738, such as a ceiling, wall, bookcase, or desk. Additionally or alternatively, illumination device 710A may be supported from the ground by a base, such as in a free-standing lamp configuration. Illumination device may also by supported in handheld devices, such as flashlight, lantern, or torch bodies.

Illumination device 710A may include any and all components necessary for proper functioning of light source 714A. For example, ballasts, internal connection components, such as wires and other circuitry, and suitable insulating materials may be included as necessary. Further, in some examples, illumination device 710A may include a portable power source, such as a battery, a generator, or a fuel cell, to power light source 714A.

Additionally or alternatively to primary reflector 712A, illumination device 710A may include a secondary reflector 740 having a reflective surface 742. As shown in FIG. 24, secondary reflector 740 may be supported by primary reflector 712A and extend beyond primary reflector 712A. By extending beyond primary reflector 712A, secondary reflector 740 may reflect light emanating from light source 714A that would not be reflected by primary reflector 712A. Additionally or alternatively, secondary reflector 740 may reflect again light that was previously reflected by primary reflector 712A.

In some examples, secondary reflector 740 is configured to reflect light towards a second target illumination area. The second target illumination area may be the same or different than the first target illumination area towards which primary reflector 712A may reflect light. The size, the angle and orientation, and the shape of secondary reflector 740 may influence how it reflects light. In some examples, secondary reflector 740 is frustoconical. A frustoconical secondary reflector 740 may enclose an inner volume and orient interior surface 742 at a non-90 degree angle to light emanating from light source 714A and reflecting from primary reflector 712A.

While the invention has been described in connection with what is presently considered the most practical and preferred embodiment(s), it is to be understood that the invention is not limited to the disclosed embodiment(s) but, on the contrary is intended to cover various modifications and equivalent arrangements included within the scope of the appended claims.

What is claimed is:

1. An illumination device comprising:

a primary reflector including a curved and reflective exterior surface that partially encloses an interior space and that defines an effective radius and a curved path; and a light source spaced from the exterior surface of the primary reflector a distance equal to approximately one-half the effective radius and at least partially within the interior space, the light source being curved to compliment and substantially follow the curved path.

2. The illumination device of claim 1, wherein the curved path extends substantially in a plane.

3. The illumination device of claim 1, wherein the curved path defines a spiral.

4. The illumination device of claim 1, wherein the light source is disposed entirely within the interior space.

5. The illumination device of claim 1, wherein the light source has a circular cross section.

6. The illumination device of claim 1, wherein the light source includes a light emitting diode.

7. The illumination device of claim 1, wherein the primary reflector is configured to reflect light substantially towards a target illumination area; and the illumination device further comprises a second reflector supported by the primary reflector, the second reflector extending beyond the primary reflector to reflect at least a portion of the light emanating from the light source that is not directed to the primary reflector to the target illumination area.

8. An illumination device comprising:

an elongate light source extending along a curved path substantially in a plane; and a primary reflector extending along the curved path, the primary reflector being spaced from the light source and being curved to at least partially surround the light source.

9. The illumination device of claim 8, wherein the curved path defines a spiral.

10. The illumination device of claim 8, wherein the light source extends between a first end and a second end and the light source includes a bend to define a bent configuration in which the first end is adjacent to the second end.

11. The illumination device of claim 10, wherein:

the curved path defines a spiral having a center region; and the first end is adjacent to the second end proximate the center region.

12. The illumination device of claim 10, wherein the light source in the bent configuration is complimentarily curved with the curved path and the light source in the bent configuration substantially follows the curved path.

13. The illumination device of claim 8, wherein the curvature of the primary reflector at least partially surrounds the light source and defines an effective radius and the primary reflector is spaced from the light source a distance equal to approximately one-half the effective radius.

14. The illumination device of claim 8, wherein the light source includes a light emitting diode.

15. The illumination device of claim 8, further comprising a frustoconical secondary reflector supported by the primary reflector.

16. The illumination device of claim 15, wherein the primary reflector reflects light substantially towards a target illumination area and the secondary reflector is supported by the primary reflector in a position to reflect light towards the target illumination area.

17. An illumination device comprising:

a primary reflector including a curved and reflective exterior surface that partially encloses an interior space and that has a curved path extending thereon; and a light source spaced from the primary reflector at least partially within the interior space and being curved to compliment and substantially follow the curved path;

wherein the light source extends between a first end and a second end and the light source includes a bend to define a bent configuration in which the first end is adjacent to the second end.

18. The illumination device of claim 17, wherein:

the curved path defines a spiral having a center region; and the first end of the light source is adjacent to the second end of the light source proximate the center region.

19. The illumination device of claim 17, wherein the light source in the bent configuration is complimentarily curved with the curved path.

* * * * *